United States Patent [19]

Mejias

[11] Patent Number: 5,069,045

[45] Date of Patent: Dec. 3, 1991

[54] PIECE OF JEWELRY

[75] Inventor: André Mejias, Vevey, Switzerland

[73] Assignee: Premiere De Tabbah SA, Fribourg, Switzerland

[21] Appl. No.: 260,395

[22] Filed: Oct. 20, 1988

[30] Foreign Application Priority Data

Oct. 26, 1987 [EP] European Pat. Off. ..... 87810612.9

[51] Int. Cl.[5] ..... A44C 5/00

[52] U.S. Cl. ..... 63/3; 63/15; 63/29.1; D11/32; D11/34

[58] Field of Search ..... 63/3, 1.1, 7, 15, 15.8, 63/29.1, 31; 29/10, 160.6; D11/34, 35, 32, 2, 26

[56] References Cited

U.S. PATENT DOCUMENTS

| | | | |
|---|---|---|---|
| D. 115,931 | 8/1939 | Kronstadt | 63/15 X |
| 774,700 | 11/1904 | Schmidt | 63/15 |
| 1,239,405 | 9/1917 | Kopetschny | 63/15 |
| 1,325,840 | 12/1919 | Feagans | 63/15 |
| 1,664,994 | 4/1928 | Rea | 63/29.1 X |
| 3,180,112 | 4/1965 | Lefkowitz | 63/29.1 |
| 3,399,547 | 9/1968 | Speilman . | |

FOREIGN PATENT DOCUMENTS

| | | | |
|---|---|---|---|
| 829363 | 1/1952 | Fed. Rep. of Germany . | |
| 490216 | 4/1919 | France | 63/29.1 |
| 577308 | 9/1924 | France . | |
| 2385352 | 3/1977 | France . | |
| 466988 | 6/1937 | United Kingdom | 63/7 |

*Primary Examiner*—Laurie K. Cranmer

*Attorney, Agent, or Firm*—Marks Murase & White

[57] ABSTRACT

The piece of jewelry, in the form of a ring, comprises a body of annular shape on the external surface of which there is provided a decoration which is attached to an arm. The arm and the decoration are situated in respective recesses in the external surface of the body. A displaceable member overlaps the body with some clearance, and it is locked into a predetermined position thereon by means of a screwed stud. In the locked position, the displaceable member completely covers the decoration. By unscrewing the stud, the displaceable member is released, and it can slide freely over the body so as to reveal the decoration. The arm, together with the attached decoration, can then pivot about a spindle mounted on the body in order to uncover personalized inscriptions situated on the external surface of the body, beneath the arm and on the two surfaces of this arm.

12 Claims, 2 Drawing Sheets

PIECE OF JEWELRY

BACKGROUND OF THE INVENTION

The present invention relates to a piece of jewelry having a generally annular-shaped body. Such a piece of jewelry may be, for example in the form of a ring or a bracelet or a simlar article.

In known embodiments of rings, bracelets or similar articles, these pieces or items of jewelry can only be personalised by an inscription provided on the internal or external surface of the body of the piece. However, such a method of distinguishing the piece of jewelry is more or less standard, the "personalisation" being limited to a different inscription for each, piece. In consequence, there exists a need to produce pieces of jewelry which can provide a more individual personalisation which differs from that of known pieces.

SUMMARY OF THE INVENTION

The object of the present invention, therefore, is to produce a piece of jewelry having component parts which serve to give it an aesthetically pleasing appearance and are provided so that they permit an improved personalisation. To achieve this object, the piece of jewelry according to the invention comprises a displaceable member, which is normally locked into a predetermined postion on said body and whose movement over the body from the locking position reveals a decoration which is attached to a component part which can be separted from the body with the revealed decoration.

By its shape, and possibly by its decoration, the displaceable member contributes towards the general aesthetic appearance of the piece of jewerly, and it permits an improved personalisation because, when it slides over the annular body of the piece, it uncovers and reveals a decoration which is normally situated in a correspondingly shaped recess provided in the external surface of the annular body, this decoration having a circular configuration or being shaped in the form of, for example, a heart; the owner of the piece of jewerly being able to select any desired shape. The decoration is attached to a pivotal arm which can be pivoted away from the annular body together with the revealed decoration. In a further embodiment of the invention, when the arm is pivoted away from the body, it uncovers a personal inscription, "LOVE" for example, on the external surface of the body, and it may itself includes, on its surface turned towards the interior (towards the body), for example, the name of the manufacturer or distributor of the piece of jewelry and, on its external portion, for example, the name of the owner of the piece and/or a special data in the life of the owner. This piece of jewerly according to the invention comprises, therefore, component parts which contribute towards its personalisation. In addition, the displaceable member, the decoration and the arm are moveable or displaceable component parts which give the piece an aesthetically pleasing appearance, whilst contributing towards its personalisation.

BRIEF DESCRIPTION OF THE DRAWINGS

The invention will be described in more detail hereinafter with reference to the drawing of two embodiments of the present invention.

DETAILED DESCRIPTION OF THE INVENTION

Figure 1:
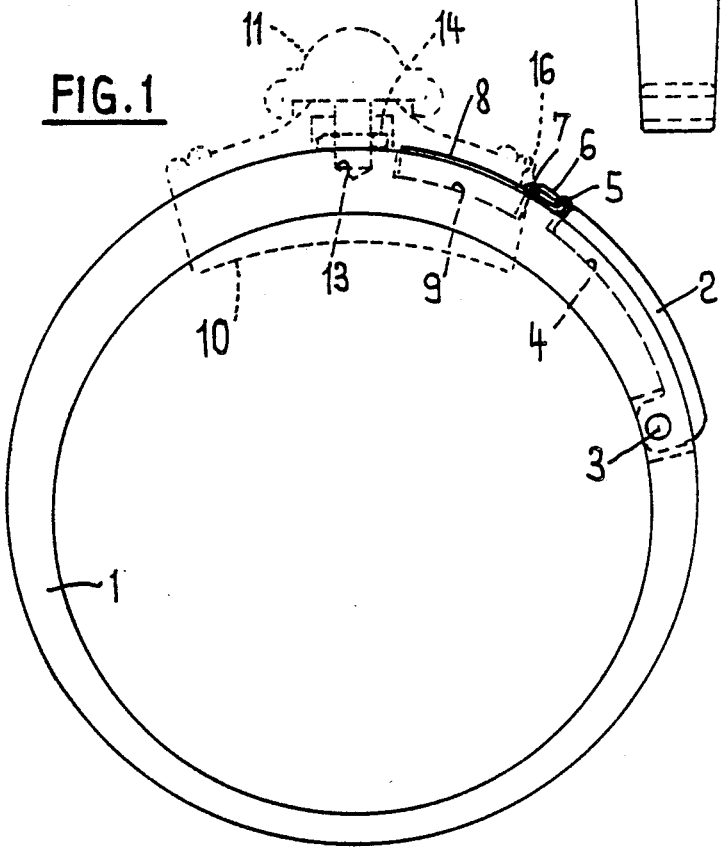
FIG. 1 is a side elevational view of a ring in accordance with a first embodiment of the invention.

FIG. 1 shows the annular body 1 of a ring in accordance with a first embodiment of the invention. This body has an arm 2 which can be pivoted about a spindle 3 which is mounted in the body 1.

Figure 4:
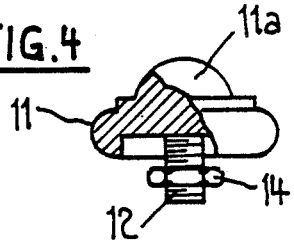
FIG. 4 illustrates a side elevational view of stud.
Figure 3:
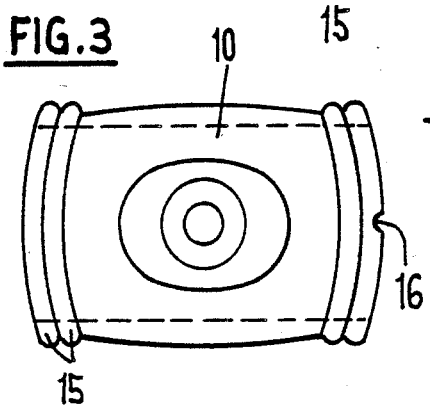
FIG. 3 is a plan view of the displaceable member of FIG. 2.
Figure 2:
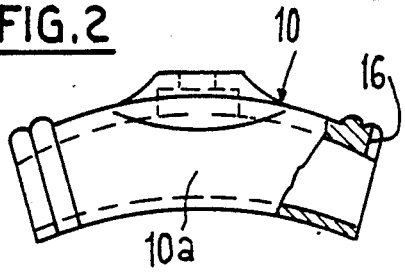
FIG. 2 is a side is a elevational view of a displaceable member.
Figure 6:
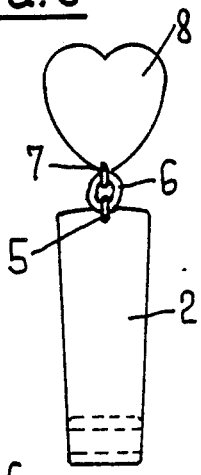
FIG. 6 is a plan view of an arm which is provided with a decoration.
Figure 5:
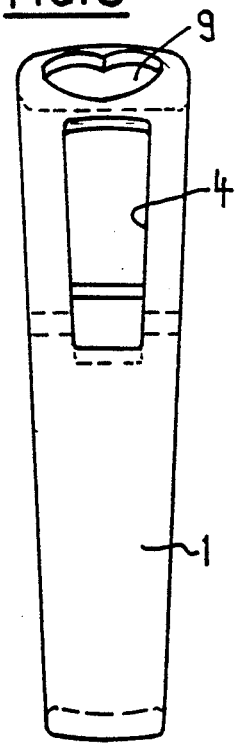
FIG. 5 is a partial plan view of the annular body of the ring shown in FIG. 1.

The internal portion of the arm 2 is normally engaged in a correspondingly shaped recess 4, which is provided in the external surface of the body 1. At its free end, the arm has a ring 5 through which a loop 6 passes, which also passes through a ring 7 mounted at one end of a decoration 8 which, in the illustrated example, is in the form of a heart, the other end of this decoration being free. The decoration 8 is engaged in a correspondingly shaped recess 9, which is provided in the external surface of the body 1. The recesses 4 and 9 are depicted in FIG. 5. The form of decoration may be selected as desired by the owner of the ring. FIG. 6 shows that the internal portion of the arm may include an inscription for example, the name of the manufacturer or distributor of the ring. The ring also includes a displaceable member 10 which is illustrated in FIG. 2 and 3. This displaceable member has a through-aperture 10*a* provided in order to accommodate the annular body 1. In consequence, the displaceable member 10 extends over the body 1 with some clearance, so that it can slide freely on the body. The displaceable member 10 is normally secured to the body 1 in a locked position by means of a stud 11. Stud 11 has a spindle 12 extending through the upper portion of the displaceable member 10, into which portion it is screwed in position, and the spindle comes to engage in a gap 13 formed in the external surface of the body 1. To release the displaceable member 10, it is sufficient to unscrew the stud 11 until the end of its spindle 12 leaves the gap 13 thus allowing displaceble member 10 to move freely along annular body. The stud is retained on the displaceable member 10 by means of a nut 14. FIG. 4 shows that the stud 11 may include, for example, a precious stone or a gold head 11*a* as its decoration. Likewise, the displaceable member 10 may be rendered more aesthetic by grooves 15 (FIG. 3). In addition, the stud 11 and the displaceable member 10 may be decorated with percious stones.

FIG. 1 shows that, when the displaceable member 10 is secured to the body 1 by means of the screwed stud 11, its right-hand portion in FIG. 2 covers and completely hides the decoration 8, the external surface of which comes practically on a level with the external surface of the body 1. The displaceable member 10 has a gap 16 which is provided in order to accommodate the ring 7 of the decoration. As indicated above, the displaceable member 10 is released by unscrewing the stud 11. The released displaceable member can then be moved over the body 1, towards the left in FIG. 1, with the result that it uncovers and reveals the decoration 8. The arm 2, which is provided with the decoration 8, can then be pivoted away from the body 1 by being rotated spindle 3, thereby permitting, on the one hand, the inscription on the internal surface of the arm 2 to be read and permitting, on the other hand, a new inscription, "LOVE" , for example, which is provided on the surface of the recess 4 of the arm 2 in the external surface of the body 1, to be uncovered (see also FIG. 5).

The above statements show that the ring can be disposed essentially into positions. In the first position, the displaceable member together with the stud is secured to the annular body 1, the decoration 8 is not visible, and the arm 2 rests against the external surface of the body 1 in its recess 4. The only visible inscription is the one which may be provided on the external surface of the arm. In the second position, the displaceable member together with the stud 11 is unlocked, and it can slide freely over the body 1 so as to uncover the decoration 8. The arm 2, which has the decoration 8 on its end, can then be pivoted away from the body 1 by being rotated about the spindle 3, thereby permitting the inscriptions on the internal surface of the arm and on the external surface of the recess of the arm in the body 1 to be read, the latter inscription normally being hidden by the arm. The displaceable member 10 and the stud 11 may have such a configuration that it improves the aesthetic appearance of the ring, and these component parts may be decorated with precious stones.

Figure 7:
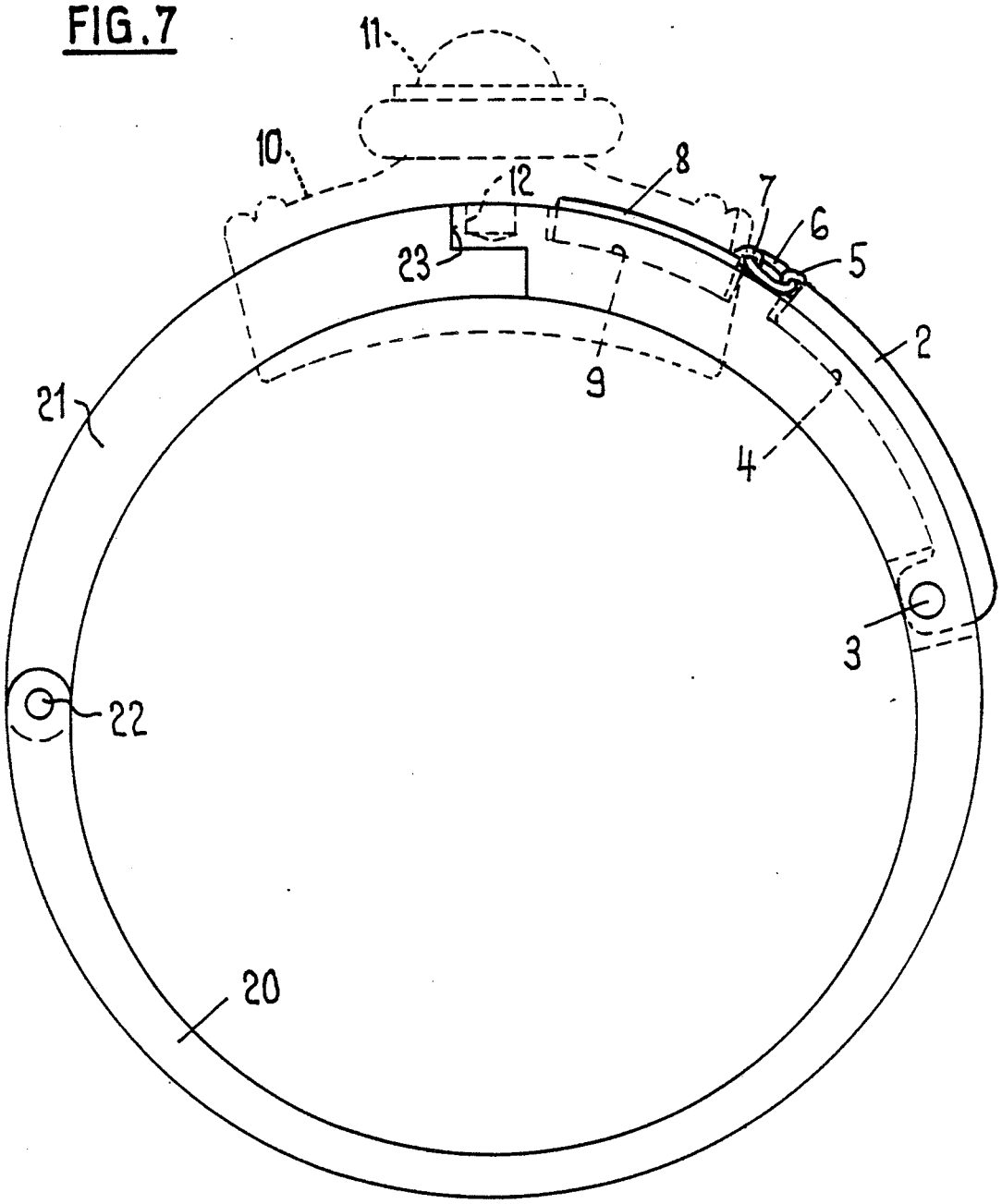
FIG. 7 is a side elevational view of a bracelet in accordance with a second embodiment of the invention.

FIG. 7 shows a bracelet in accordance with a second embodiment of the invention. This bracelet is conceived according to the same principle as the above-described ring. FIG. 7 corresponds to FIG. 1, and FIG. 2 to 6 apply both to the ring and to the bracelet. The same component parts are denoted by the same reference numerals. In the case of the bracelet, the body comprises two portions 20 and 21 which are joined together by means of a hinge 22 permit the bracelet to open when the displaceable member 10 is moved over the portion 21 of the body of the bracelet from the locking position. In addition, in the locking position, the end of the spindle 12 of the stud 11 passes into a gap 23 formed in the portion 21 of the body of the bracelet. The movement of the displaceable member 10 over the portion 21 reveals not only the decoration 8, as in the case of the ring, but also the portions 20 and 21 of the body of the bracelet which are accommodated one inside the other at the site of the gap 23, so that the bracelet can be opened by simply separating these portions one from the other. The course of travel of the displaceable member 10 over the portion 21 of the body may be limited, if necessary, by a stop member.

What is claimed:

1. A piece of jewelry comprising:

a generally annular-shaped body;

an arm having one end pivotably attached to said annular body;

a displaceable member having an aperture extending completely therethrough and through which said displaceable member is slideably engaged with said annular body to releaseably secure said arm to said annular body;

wherein said generally annular shaped body comprises two portions, each portion having two ends, one end of each portion being connected by means of a hinge and the other end of each portion forming a lap joint;

and wherein said lap joint is covered by said displaceable member when said arm is secured to said annular body by said displaceable member.

2. A piece of jewelry according to claim 1, further comprising a first recess in said annular body to receive said arm.

3. A piece of jewelry according to claim 2, wherein said arm and said first recess contain inscriptions.

4. A piece of jewelry according to claim 1, wherein a decoration is attached to a free end of said arm.

5. A piece of jewelry according to claim 4, wherein said decoration is ornametally shaped.

6. A piece of jewelry according to claim 5, wherein said decoration has a circular configuration.

7. A piece of jewelry according to claim 4, further comprising a second recess in said annular body to receive said decoration.

8. A piece of jewelry according to claim 7, wherein said second recess contains inscriptions.

9. A piece of jewelry according to claim 4, further comprising a loop means attaching said decoration to said arm.

10. A piece of jewelry according to claim 1, further comprising a spindle in said annular body to pivotally attach said arm to said annular body.

11. A piece of jewelry according to claim 1, further comprising a stud to secure said displaceable member to said annular body in a locked position.

12. A piece of jewelry according to claim 1, wherein said jewelry is a bracelet.

* * * * *